US005501262A

United States Patent [19]

Inaba et al.

[11] Patent Number: 5,501,262

[45] Date of Patent: Mar. 26, 1996

[54] CORD LOCKING ASSEMBLY FOR USE WITH VENETIAN BLIND

[75] Inventors: Tadashi Inaba; Toshiyuki Mori; Masahiro Nagashima; Kosuke Kawada, all of Tokyo, Japan

[73] Assignee: Toso Co., Ltd., Tokyo, Japan

[21] Appl. No.: 330,730

[22] Filed: Oct. 28, 1994

[30] Foreign Application Priority Data

May 7, 1993 [JP] Japan ..... 5-107052
Feb. 7, 1994 [JP] Japan ..... 6-013291

[51] Int. Cl.[6] ..... E06B 9/324

[52] U.S. Cl. ..... 160/178.2; 24/136 L; 160/173

[58] Field of Search ..... 160/178.2 R, 178.1 R, 160/173 R, 168.1 R; 24/136 L, 115 F, 129 A, 115 G

[56] References Cited

U.S. PATENT DOCUMENTS 3,633,646 1/1972 Zilver ..... 160/178.2 R

FOREIGN PATENT DOCUMENTS 2953496 3/1981 Germany ..... 160/178.2 R
57-55863 11/1982 Japan .
6-317077 11/1994 Japan .

*Primary Examiner*—Philip C. Kannan
*Attorney, Agent, or Firm*—Birch, Stewart, Kolasch & Birch

[57] ABSTRACT

A cord locking assembly mounted in the blind head box or the blind hand grip axially movably fitted on the hollow pole suspended from the blind head box.

The assembly comprises a movable plug, a fixed plug hole sleeve for fitting engagement with the plug, a lock compression spring to bias the plug to the plug hole sleeve, lift cords passing through the plug hole sleeve, and means for loosening the lock compression spring. The means is the hand grip in the case of the assembly mounted the hand grip. The means is a knob or pull cord fixed to a holder in which the lock compression spring is mounted in the case the assembly mounted in the blind head box.

The lift cords are fixedly locked between the plug and the plug hole sleeve when the means is not operated, are gradually movably locked between the plug and the plug hole sleeve when the means is operated at first to loosen the lock compression spring without moving the plug away from the plug hole sleeve, and released from the locking between the plug and the plug hole sleeve when the means is operated at last to move the plug away from the plug hole sleeve.

9 Claims, 7 Drawing Sheets

CORD LOCKING ASSEMBLY FOR USE WITH VENETIAN BLIND

BACKGROUND OF THE INVENTION

The present invention relates to a cord locking assembly for use with a Venetian blind. When the blind lift cords are released from the cord locking assembly, the blind falls under its own weight. The invention relates more particularly to improvements in a locking mechanism by which the blind is prevented from suddenly falling when the lift cords are released from the cord locking assembly.

The known cord locking assembly has a fixed member, a movable member resiliently biassed to the fixed member, and a releasing member to move the movable member away from the fixed member. The lift cords are locked between the both members when the releasing member is free, and released from the locking between the both members when the releasing member is operated to move the movable member away from the fixed member.

The cord locking assembly as disclosed in JP B 57-55863 has a hollow pole suspended from the head box, a hand grip axially movably fitted on the lower end portion of the pole, lift cord ends extended outwardly from the bottom of the grip, and a cord locking assembly mounted within the hand grip. The assembly has a plug hole formed in the bottom off the pole and a plug fixedly mounted within the grip for fitting engagement with the plug hole. The lift cords pass through between the plug and the plug hole. The plug is biassed upwardly to the plug hole under the action of a compression spring interposed between the pole and the grip.

When the grip is released, the compression spring raises the grip and inserts the plug into the plug hole so that the lift cords are locked between the plug and the plug hole. Then, the lift cords are locked to rest the blind at that position.

When the cord ends are pulled down by hand against the friction between the plug and the plug hole under the action of the compression spring, the blind is lifted.

When the grip is drawn down by hand against the compression spring, the plug is caused to slip out of the plug hole so that the lift cords are unlocked. Once the lift cords are unlocked, the blind falls suddenly under its own weight. When the blind is at a high position, it will fall at dangerous speeds, unless a person pulls down the grip by one hand to unlock the lift cords while he holds the lift cord ends by the other hand to prevent the rapid fall of the blind. But, it is not easy to operate the grip by one hand and the cord ends by the other hand.

SUMMARY OF THE INVENTION

The present invention is intended to provide such a Venetian blind cord locking assembly that is operatable by a single hand and capable of preventing the sudden fall of the blind.

The inventive assembly is available for the Venetian blind of the type having a hollow pole suspended from a head box and having two or three cords ends extending from the bottom end of the pole, so that the blind has its slats tiltable upon rotation of the pole and liftable by pulling the cord ends. It is also available for the Venetian blind of the type having no hollow pole.

In the case of the hollow pole with a hand grip having a relatively large diameter, the cord locking assembly is preferably mounted in the hand grip.

In the case of the hollow pole without a hand grip or with a hand grip having a relatively small diameter, the assembly is preferably mounted in the blind head box. In this case, the pole is provided without a hand grip or with a hand grip having an outer diameter slightly larger than the pole.

The assembly according to the present invention can be mounted in either of the blind head box and the hand grip axially movably fitted on the lower end portion of a hollow pole suspended from the blind head box. The assembly mounted in the hand grip comprises a plug hole sleeve coaxially fixed to the bottom of the hollow pole, a plug axially movably mounted under the bottom of the pole within the hand grip for fitting engagement with the plug hole sleeve, a lock compression spring interposed between the plug and the hand grip to bias the plug to the plug hole sleeve, an auxiliary compression spring interposed between the hollow pole and the hand grip to upwardly bias the hand grip, and lift cords entering the hand grip through the plug hole sleeve and leaving the hand grip through the bottom thereof.

The assembly in the head box comprises a housing mounted in the head box, a holder axially movably mounted in the housing, a plug axially movably mounted in the holder, a plug hole sleeve provided in one longitudinal side of the housing, a lock compression spring interposed between the plug and the holder to bias the plug to the plug hole sleeve, an auxiliary compression spring interposed between the holder and the housing to bias the holder to the one longitudinal side of the housing, a releasing means for moving the holder toward the other longitudinal side of the housing against the auxiliary spring, and lift cords entering the housing through the plug hole sleeve and leaving the housing through the other longitudinal side thereof.

In preference, the plug is centrally formed with a conical head to be inserted into the plug hole sleeve and peripherally formed with a plurality of cord holes to guide the lift cords across the plug.

The releasing means is either of a pull cord and a knob. The pull cord has its end pulled out of the pole for operation. The knob protrudes from an opening in the blind head box for operation.

When the blind rests, the plug is so inserted into the plug hole sleeve under the action of the both compression springs that the lift cords are tightly caught in between the plug and the plug hole sleeve.

When the hand grip or releasing means is firstly operated to loosen the lock compression spring and compress the auxiliary spring to a certain extent that, the plug remains unmoved in the plug hole sleeve, the lift cords are allowed to gradually slip between the plug and the plug hole sleeve. Then, the blind lowers slowly under its own weight but is prevented from falling rapidly due to the frictional resistance between the plug and the plug hole sleeve.

The lift cords are weighted by the bottom rail and the closed slats, the latter reducing in number as the blind falls. This means that the blind would not fall down to the lowermost position unless the lift cords are unlocked completely after the blind has lowered more than half. Then, the hand grip or releasing means is operated at last to the full extent that the plug moves away from the plug hole sleeve to unlock the lift cords completely from the locking between the plug and the plug hole sleeve.

The advantages offered by the invention are mainly that the blind is always prevented from suddenly falling once the lift cords are unlocked, and that the blind usually lowers at safety speeds by a single hand operation even if it has been raised at the uppermost position. The inventive assembly is available for the Venetian blind with or without a hollow pole. All in all, the blind is free from accidents due to its own rapid drop.

DESCRIPTION OF THE PREFERRED EMBODIMENTS

The present invention is explained in detail below with reference to drawing which illustrate the preferred embodiments.

Figure 1:
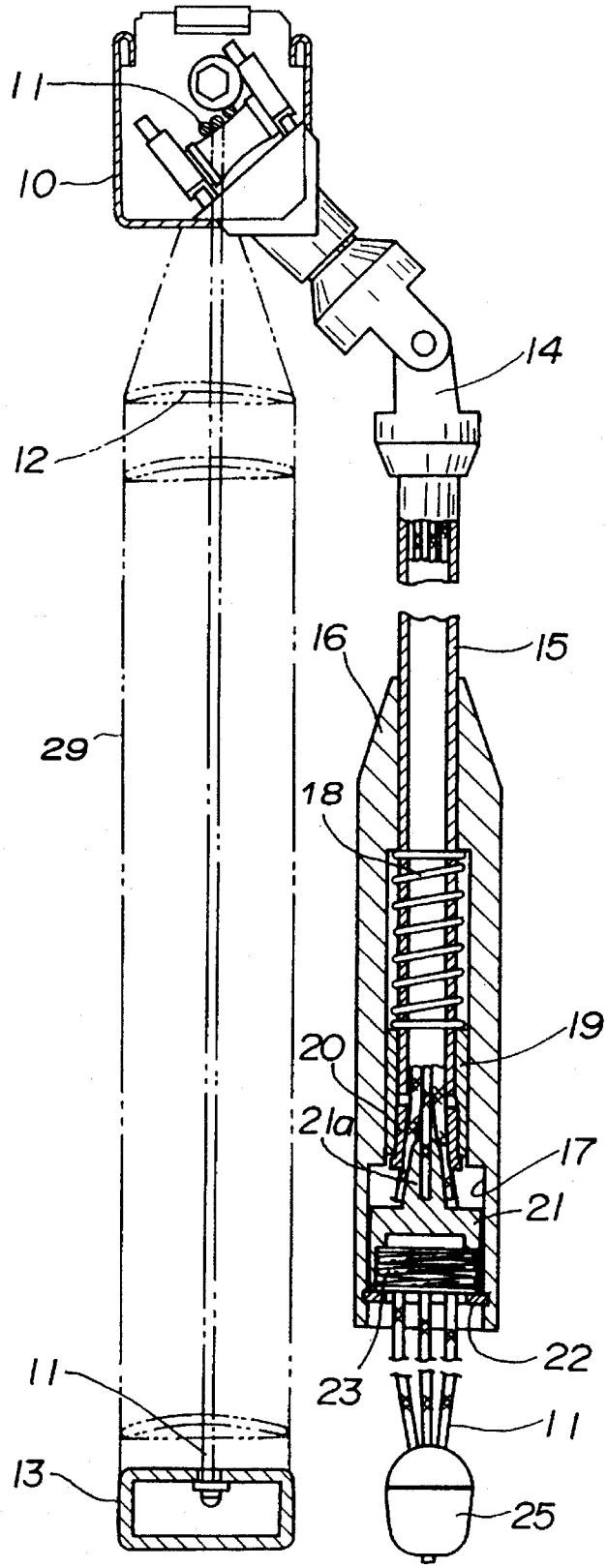
FIG. 1 is a side, partly sectional view of the relevant portion of the Venetian blind provided with an embodiment of the assembly according to the invention.

As seen in FIG. 1, the Venetian blind has three lift cords 11 each having one end extended downward from the head box 10 through slats 12 to the bottom rail 13. The slats 12 are supported by the lift cords 11 when unfolded but by the ladder cords 29 when folded. When the lift cords 11 are unlocked, the blind falls under its own weight corresponding to the weight of the slats 12 folded and the bottom rail 13. This blind weight is minimum or similar to the weight of only the bottom rail 13 when the blind is at the lowermost position, and maximum or similar to the weight of all the slats 12 and the bottom rail 13.

The other end of the lift cord 11 extends to the pole 15 from the head box 10 through the hollow joint 14. A hand grip 16 is axially movably fitted on the bottom portion of the pole 15. The lift cords 11 have the other ends pulled out of the bottom of the grip 16 and then terminated by a common bead 25.

Figure 2:
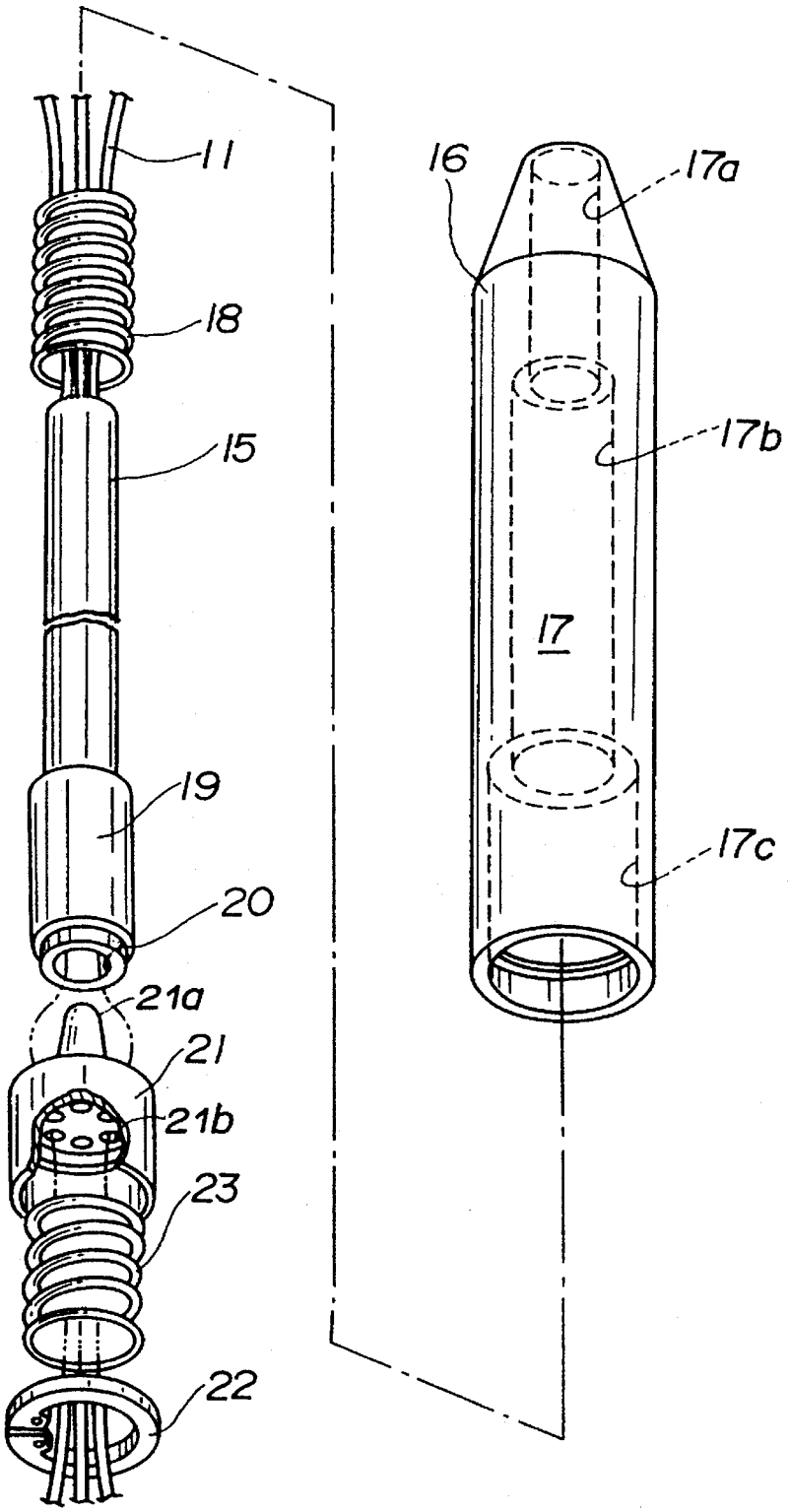
FIG. 2 is an exploded, perspective view of the assembly of FIG. 1.

As seen in FIGS. 1 and 2, the grip 16 has a through bore 17 composed of upper, middle and lower portions 17*a*, 17*b* and 17*c*. The upper portion 17*a* has an inner diameter slightly larger than the outer diameter of the pole 15. The middle portion 17*b* is diametrally larger than the upper portion 17*a* to receive both a bushing 19 fitted on the bottom of the pole 15 and an auxiliary compression spring 18 loosely coiled on the pole 15. The auxiliary spring 18 is interposed between the upper annular end of the middle portion 17*b* and the upper end of the bushing 19. The lower portion 17*c* is diametrally larger than the middle portion 17*b* to receive a plug 21. The plug 21 is axially movably mounted within the lower portion 17*c* and prevented from slipping out of the grip 16 by a snap ring 22, which is fixedly disposed at the bottom of the lower portion 17*c*. A lock compression spring 23 is interposed between the plug 21 and the snap ring 22 to upwardly bias the plug 21. A plug hole sleeve 20 is fitted in the bottom of the bushing 19. The plug 21 is formed at its top center with a conical head 21*a* to be inserted into the plug hole sleeve 20. The plug 21 is also formed with a plurality of cord holes 21*b* surrounding the head. The lift cords 11 pass through the pole 15, through the plug hole sleeve 20, through the cord holes 21*b*, through the lock spring 23, and through the snap ring 22 and then extend outwardly from the bottom of the grip 16.

When the blind or the bottom rail 13 rests, the plug 21 is inserted into the plug hole sleeve 20 under the action of the both compression springs 18 and 23, so that the lift cords 11 are fixedly clamped between the plug 21 and the plug hole sleeve 20.

Figure 3:
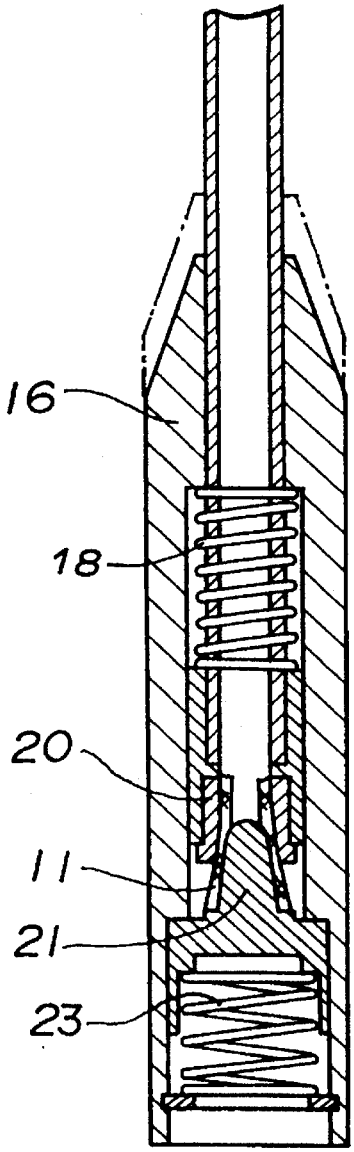
FIGS. 3 and 4 are sectional views of the assembly of FIG. 1, illustrating the respective positions in which the pull cord is half drawn and in which the pull cord is fully drawn.

Referring to FIG. 3, in which the grip 16 is firstly drawn from the initial position shown by one-dot chain lines to a halfway position shown by solid lines against the auxiliary spring 18, the lock spring 23 loosens though the plug 21 remains unmoved. The lift cords 11 are allowed to gradually slip between the plug 21 and the plug hole sleeve 20, so that the blind lowers slowly under its own weight but is prevented from falling rapidly due to the frictional resistance between the plug and the plug hole sleeve. Thus, the blind falls at safety speeds upon operation of the hand grip 16 by a single hand even if it has been raised at the uppermost position.

Figure 4:
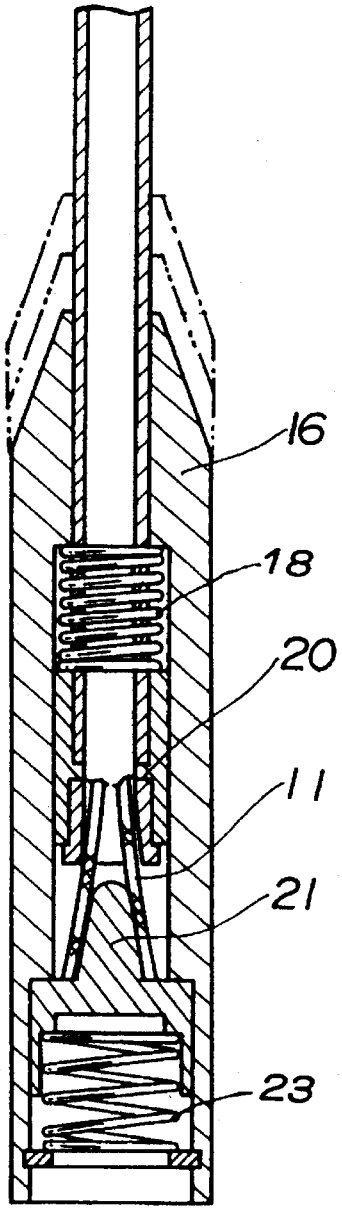

Referring to FIG. 4, in which the initial position of the grip 16 is shown by one-dot chain lines, the grip 16 is further drawn from the halfway position shown by two-dot chain lines to the lowest position shown by solid lines. The auxiliary spring 18 is fully compressed. The plug 21 lowers together with the lock spring 23 loosened and slips out of the plug hole sleeve 20. The lift cords 11 are free from the locking between the plug 21 and the plug hole sleeve 20, so that the blind falls down to the lowermost position.

Figure 5:
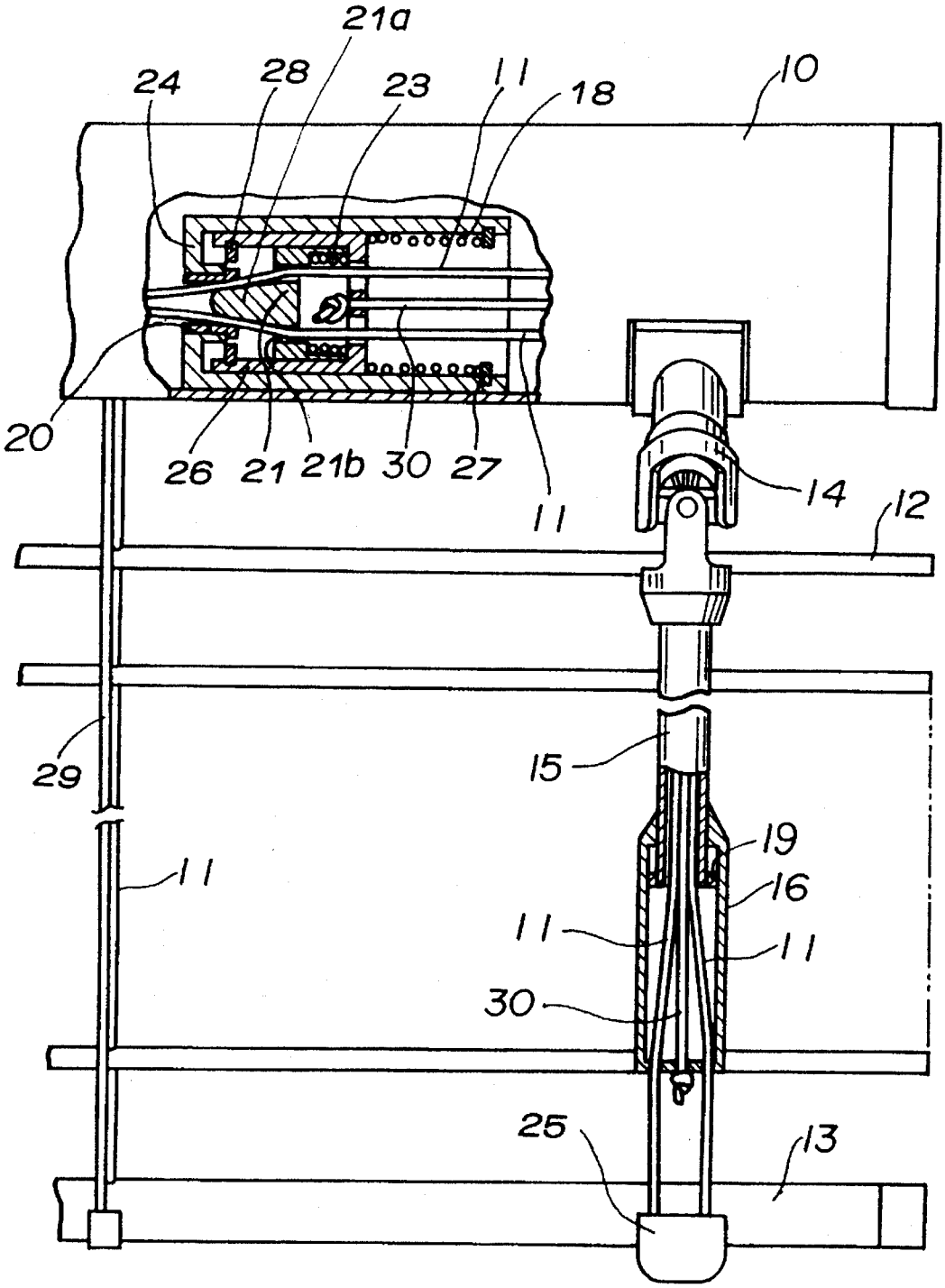
FIG. 5 is a front, partly sectional view of the relevant portion of the Venetian blind provided with another embodiment.

As seen in FIG. 5, the Venetian blind has two lift cords 11 each having one end extended downward from the head box 10, through slats 12, and to the bottom rail 13. The slats 12 are supported by the lift cords 11 when unfolded but by the ladder cords 29 when folded. When the lift cords 11 are unlocked, the blind falls under its own weight corresponding to the weight of the slats 12 folded and the bottom rail 13. The blind weight is minimum or similar to the weight of only the bottom rail 13 when the blind is at the lowermost position, and maximum or similar to the weight of the all the slats 12 and the bottom rail 13 when the blind is at the uppermost position.

The other end of the lift cord 11 extends to the pole 15 from the head box 10 through the hollow joint 14. A grip 16 is axially movably fitted on the bottom portion of the pole 15. The other ends of the lift cords 11 are pulled outwardly from the pole 15 and then terminate at a bead 25. The hollow pole 15 is provided at the bottom end thereof with a bushing 19 to prevent the hand grip 16 from slipping down out of the pole 15.

Figure 6:
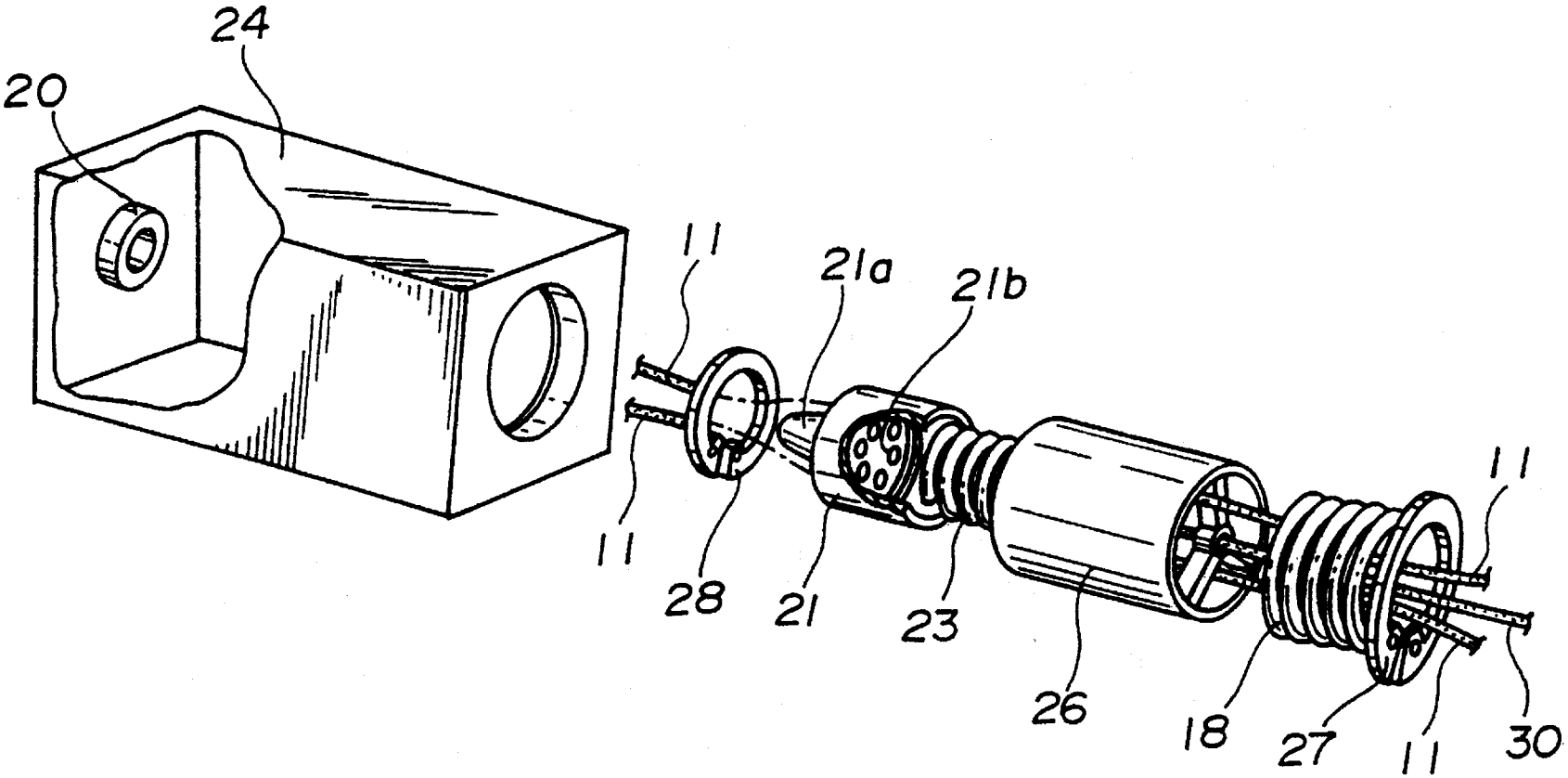
FIG. 6 is an exploded, perspective view of the assembly of FIG. 5.

As seen in FIGS. 5 and 6, a housing 24 is mounted within the head box 10. The housing 24 has the same longitudinal direction with the head box 10. A tubular holder 26 is longitudinally movably mounted within the housing 24. A plug 21 is axially movably mounted within the holder 26. The holder 26 is biassed toward one longitudinal side of the housing 24 under the action of an auxiliary compression spring 18, which is interposed between the holder 26 and a snap ring 27 at the other longitudinal side of the housing 24.

The housing 24 is provided at the longitudinal side with a plug hole sleeve 20. The plug 21 is formed at its center with a conical head 21*a* for fitting engagement with the plug hole sleeve 20. The plug 21 is formed about the head 21*a* with a plurality of cord holes 21*b* or cord grooves to guide the lift cords 11 across the plug 21. A lock spring 23 is interposed between the plug 21 and the holder 26. The head 21*a* is inserted into the plug hole sleeve 20 under the action of both the compression springs 18 and 23. A snap ring 28 is fitted in the one longitudinal side of the holder 26.

A pull cord 30 has an end attached to the other longitudinal side of the holder 26. The other end of the pull cord 30 extends together with the lift cords 11 from the head box 10, through the hollow universal joint 14, and through the pole 15 and to the bottom of the grip 16. The cord 30 is arranged to pull the holder 26 toward the other longitudinal side of the housing 24 against the auxiliary spring 18, when the grip 16 is drawn downwardly. Two lift cords 11 enter the holder 26 through the plug hole sleeve 20 at the one longitudinal side of the housing 24, and cross the plug 21 through the cord holes 21*b*. Thereafter, the cords 11 leave the housing 24 through the snap ring 27 at the other longitudinal side of the housing 24.

When the bottom rail rests, under the action of both the compression springs 18 and 23, the plug 21 is so inserted into the plug hole sleeve 20 that the cords 11 are fixedly caught between the plug 21 and the plug hole sleeve 20.

Figure 7:
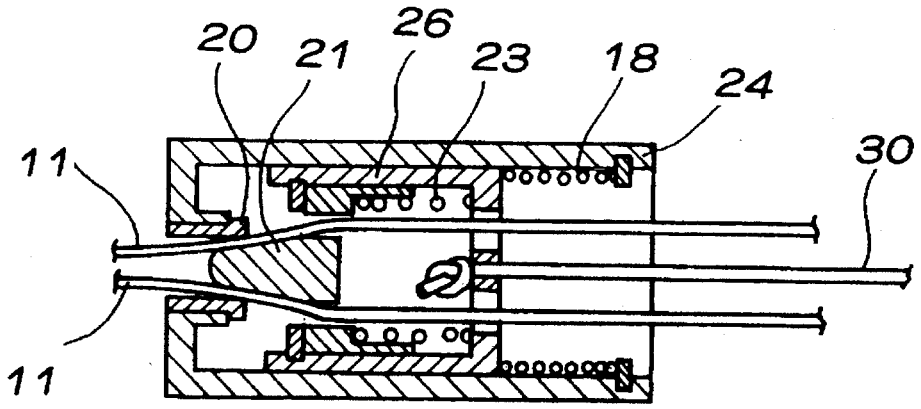
FIGS. 7 and 8 are sectional views of the assembly of FIG. 5, illustrating the respective positions in which the pull cord is half drawn and in which the pull cord is fully drawn.

When the grip is firstly pulled down, the cord 30 is drawn to compress the auxiliary spring 18 by half and move the holder 26 toward the other longitudinal side of the housing 24 to a certain extent that the lock spring 23 loosens while the plug 21 remains unmoved as seen in FIG. 7. Then, the lift cords 11 are allowed to gradually slip between the plug 21 and the plug hole sleeve 20, so that the blind lowers slowly under its own weight due to the frictional resistance between the plug and the plug hole.

Figure 8:
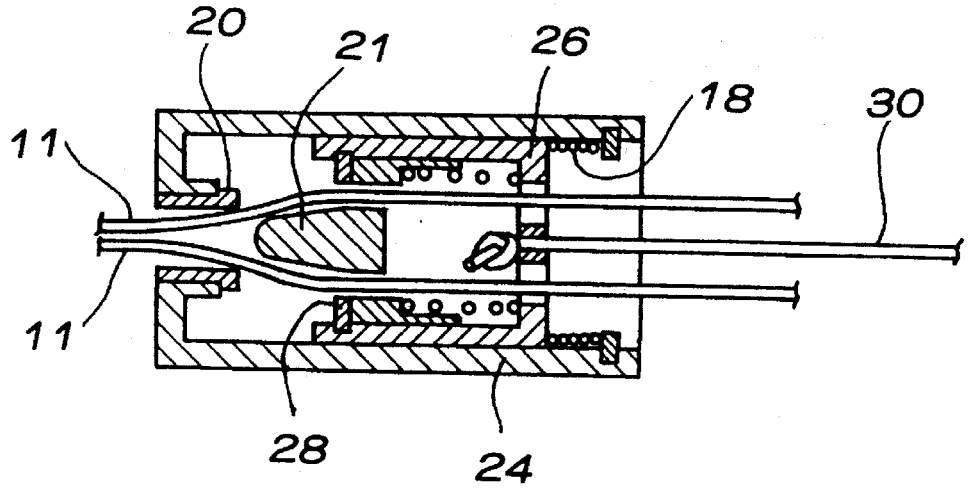

When the grip is lastly pulled down, the cord 30 is drawn to compress the auxiliary spring 18 in full and move the holder 26 to the other longitudinal side of the housing 24 to the full extent that the snap ring 28 causes the plug 21 to move away from the plug hole sleeve 20 and release the lift cords 11 from the locking between the plug 21 and the plug hole sleeve 20, as seen in FIG. 8. Thus, the bottom rail lowers at the lowermost position.

The grip 16 has no other role than a bead terminating the cord 30. It is required to be axially movably fitted on the pole 15 and have such an outer diameter that is somewhat larger than the pole 15. The grip can be eliminated if the cord is so pulled down outwardly from the lower end of the pole and operable apart from the lift cords 11. At any rate, the blind falls at safety speeds upon operation of the hand grip or the pull cord by a single hand even if it has been raised at the uppermost position.

Figure 9:
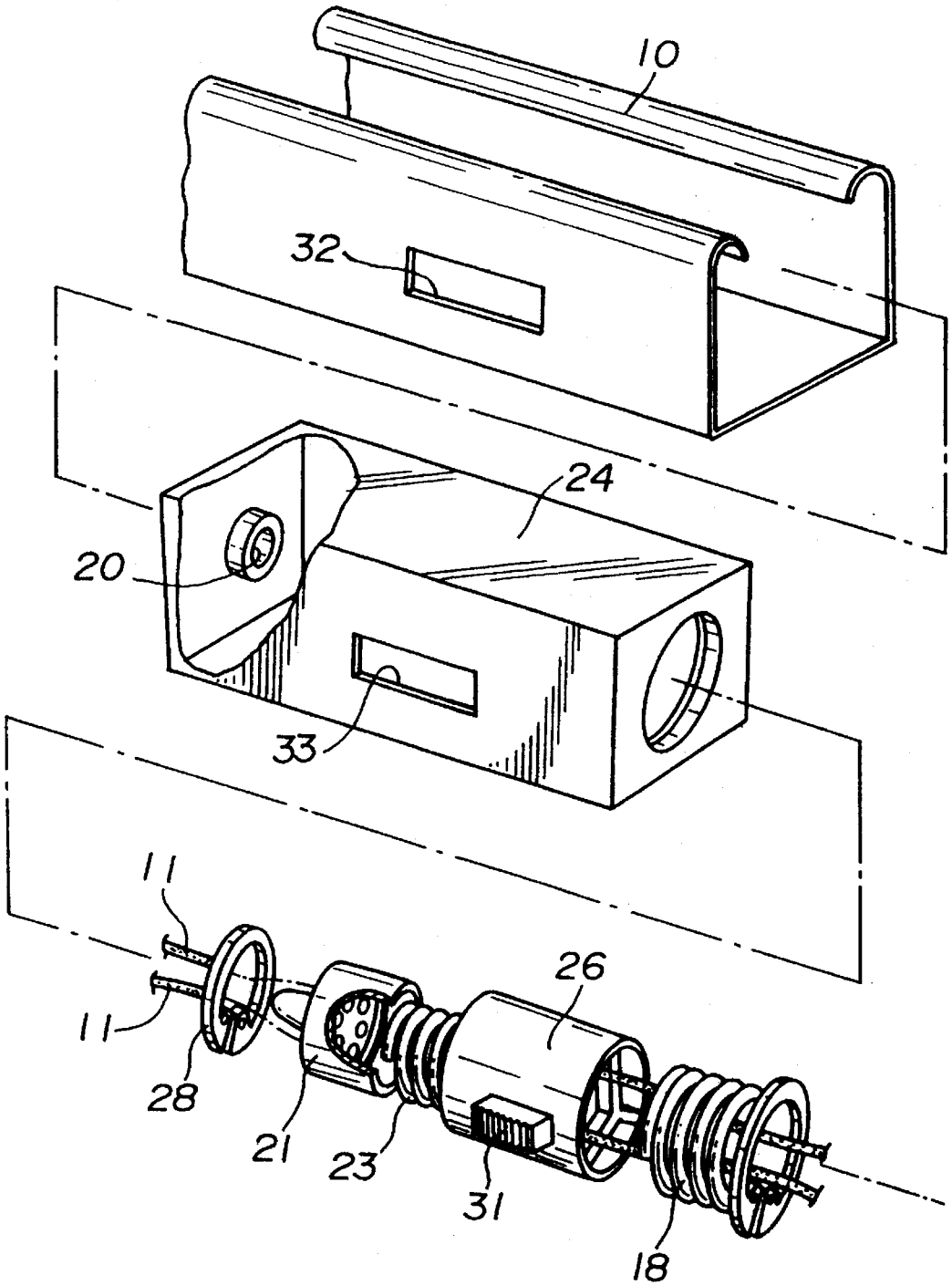
FIG. 9 is an exploded, perspective view of still another embodiment with a knob.

As seen in the embodiment of FIG. 9, a cord is substituted by a knob 31 which is fixed to the holder 26. The embodiment allows the blind to have no cord passing through the pole, nor grip to be fitted on the bottom portion of the pole.

The knob 31 projects outwardly from a window 32 formed in the front of the head box 10 through a window 33 formed in the front of the housing 24. The plug 21 is inserted into the plug hole sleeve 20 under the action of both the compression springs 18 and 23 to lock the lift cords 11 between the plug 21 and the plug hole sleeve 20 when the blind rests.

When the knob 31 firstly is moved by half against the auxiliary spring 18 toward the other longitudinal side of the housing 24, the lock spring 23 loosens while the plug 21 remains unmoved. Then, the lift cords 11 are allowed to gradually slip between the plug 21 and the plug hole sleeve 20 so that the blind falls slowly under its own weight. Thus, the blind falls at safety speeds upon operation of the knob 31 by a single hand even if it has been raised at the uppermost position.

When the knob 31 is lastly shifted to move the holder 26 to the full extent that the snap ring 28 causes the plug 21 to move away from the plug hole sleeve 20. Then, the lift cords 11 can move freely so that the blind falls down to the lowermost position under its own weight.

What is claimed is:

1. A cord locking assembly for use with a Venetian blind of the type having a head box, a hollow pole suspended from the head box, a hand grip axially movably fitted on the bottom portion of the hollow pole, said assembly comprising a plug hole sleeve coaxially fixed to the bottom of the hollow pole, a plug disposed within the hand grip for fitting engagement with the plug hole sleeve from underside, an auxiliary compression spring interposed between the grip and the pole to upwardly bias the grip, and lift cords entering the grip through the plug hole sleeve and leaving the grip through the bottom thereof, the plug being axially movably mounted within the hand grip and upwardly biassed by a lock compression spring interposed between the plug and the hand grip, whereby the lift cords are fixedly locked between the plug and the plug hole sleeve when the hand grip is not operated, whereby the lift cords are gradually movably locked between the plug and the plug hole sleeve when the hand grip is operated to a certain extent that the lock compression spring loosens while the plug remains unmoved, and whereby the lift cords are released from the locking between the plug and the plug hole sleeve when the hand grip is operated to the full extent that the plug moves away from the plug hole sleeve.

2. The assembly as claimed in claim 1, wherein the plug is centrally with a conical head to be inserted into the plug hole sleeve and peripherally formed with a plurality of cord holes to guide the lift cords across the plug.

3. The assembly as claimed in claim 1, wherein the hand grip has a through bore composed of upper, middle and lower parts, the upper part being movably fitted on the hand pole, the middle part being diametrally larger than the upper part to receive the auxiliary compression spring interposed between the upper annular end of the middle part and a bushing fixedly fitted on the bottom of the hand pole, the lower part being diametrally larger than the middle part to receive the plug and the lock compression spring interposed between the plug and a snap ring fitted in the bottom of the lower part.

4. A cord locking assembly for use with a Venetian blind comprising a head box, a housing mounted in the head box, a plug hole sleeve provided in one longitudinal side of the housing, a plug mounted in the housing for fitting engagement with the plug hole sleeve and biassed toward the one longitudinal side of the housing by a lock compression spring, lift cords entering the housing from the plug hole sleeve and leaving the housing from the other longitudinal side thereof, and a releasing means for releasing the lift cords from the locking between the plug and plug hole sleeve, the plug being longitudinally movably mounted within a holder, which is longitudinally movably mounted within the housing, the lock compression spring being interposed between the plug and the holder, the holder being biassed toward the one longitudinal side of the housing by an auxiliary compression spring interposed between the housing and the holder, and the releasing means being operatable to move the holder toward the other longitudinal side of the housing, whereby the lift cords are fixedly locked between the plug and the plug hole sleeve when the releasing means is not operated, whereby the lift cords are gradually movably locked between the plug and the plug hole sleeve when the releasing means is operated to a certain extent that the lock compression spring loosens while the plug remains unmoved, and whereby the lift cords are released from the locking between the plug and the plug hole sleeve when the releasing means is operated to the full extent that the plug moves away from the plug hole sleeve.

5. The assembly as claimed in claim 4, wherein the plug is centrally with a conical head to be inserted into the plug hole sleeve and peripherally formed with a plurality of cord holes to guide the lift cords across the plug.

6. The assembly as claimed in claim 4, wherein the releasing means comprises a knob fixed to the holder, the knob projecting in front through a window in the head box and through a window in the housing.

7. The assembly as claimed in claim 4, wherein the releasing means comprises a pull cord having an end fixed to the holder and the other end extended from the head box for operation.

8. The assembly as claimed in claim 7, wherein the blind has a hollow pole suspended from the head box, the other end of the pull cord passing through the pole and being pulled out of the bottom thereof.

9. The assembly as claimed in claim 7, wherein the blind has a hollow pole suspended from the head box and a hand grip axially movably fitted on the bottom portion of the pole, the other end of the pull cord passing through the pole and being fixed to the grip.

* * * * *